US005566924A

United States Patent [19]

Shirk

[11] Patent Number: 5,566,924

[45] Date of Patent: Oct. 22, 1996

[54] PORTABLE POWERED STAKE PULLER

[76] Inventor: J. Edwin Shirk, 355 Hammertown Rd., Narvon, Pa. 17555

[21] Appl. No.: 606,802

[22] Filed: Feb. 26, 1996

[51] Int. Cl.[6] ..... B25C 11/00

[52] U.S. Cl. ..... 254/18

[58] Field of Search ..... 254/18, 29 R, 254/30, 31

[56] References Cited

U.S. PATENT DOCUMENTS

| | | | |
|---|---|---|---|
| 222,112 | 11/1879 | Wilson | 254/18 |
| 871,083 | 11/1907 | Brown | 254/18 |
| 1,771,712 | 7/1930 | Jimerson | 254/18 |
| 2,570,914 | 10/1951 | Buck | 254/18 |
| 2,570,915 | 10/1951 | Buck | 254/18 |
| 2,709,570 | 5/1955 | Henry | 254/18 |
| 2,797,889 | 7/1957 | Talboys | 254/18 |
| 2,874,933 | 2/1959 | Feucht | 254/18 |
| 5,253,844 | 10/1993 | Cotic et al. | 254/18 |

*Primary Examiner*—Robert C. Watson
*Attorney, Agent, or Firm*—Martin Fruitman

[57] ABSTRACT

The apparatus is a portable stake puller powered by a gasoline engine. The lifting action is produced by an endless chain conveyor that raises a jaw assembly which is pivoted to grip the spike. The jaw assembly is released from the chain by a mechanical unlatching action when it hits a stop near the top of a guiding channel, and, once released, the jaw assembly drops down to the bottom of the channel from its own weight, reconnects to the chain, and is ready to engage another spike.

9 Claims, 3 Drawing Sheets

PORTABLE POWERED STAKE PULLER

BACKGROUND OF THE INVENTION

This invention deals generally with applying pulling force as in a nail extractor, and more specifically with a portable spike puller for items such as tent stakes.

Pulling tent stakes out of the ground can be more of a task than most of us realize. This is mostly because, in the world of commerce, tent stakes are not the short, thin rods which are used for camping tents. Instead, when used for large commercial tents such as those rented for parties, large sales events, and other special events, tent stakes are typically one inch diameter rods constructed from the same material as reinforcing rods for concrete and are almost two foot long. Usually a jack hammer is used to pound this type of stake into asphalt paving or hard ground. Such a stake can not be pulled from the ground by hand by merely loosening it with a few blows against its exposed top.

Perhaps the most similar task to pulling such a large tent stake is that of pulling railroad tie spikes. In that situation, although railroad spikes are not as long as large tent stakes, the pulling force required is probably comparable. The major difference between removing spikes from railroad ties and pulling large tent stakes from the ground is, however, the availability of powerful machines at the railroad tracks and the requirement to remove tent stakes in areas which have poor access for large power sources. For instance, typical railroad spike pullers use pneumatic or hydraulic power, which means that a source of such power must be nearby, and hoses must be moved between locations of the spikes to be removed. Such an arrangement is extremely difficult to use at the typical isolated site at which large tents are erected.

The removal of large tent stakes is a task which would be aided considerably by a portable tool with an integrated power source which could be moved and operated by one person.

SUMMARY OF THE INVENTION

The present invention is a stake puller which weighs less than 50 pounds, so it can be moved and operated by one person, yet it includes its own power source and provides a pulling force of over 2500 pounds. The apparatus automatically engages the stake to be pulled, moves the stake up through a stroke of over 20 inches, disengages from the stake, and rapidly returns to the lower position for engaging another stake.

This is accomplished by using a small, high speed gasoline engine to drive an endless chain through a large reduction gear drive. The endless chain moves around the drive sprocket, located, along with the engine and the gear drive, at one end of a two foot long box frame, and around the bottom sprocket located at the opposite end, the bottom, of the box frame.

A stake gripper assembly moving within a guide slot is alternately dropped to the bottom of the box frame and then lifted to the top. The chain is engaged by the gripper assembly when the gripper assembly is located at the bottom of the box frame, and the chain is automatically disengaged from the gripper assembly when the gripper assembly reaches the top of the predetermined stroke. The engagement of the chain with the gripper assembly is accomplished by a simple pivoting lever, a dog, which engages the links of the chain. This dog is pivoted into engagement with the chain by a bottom mechanical stop located at the lower end of the gripper assembly's travel, and the dog is pushed out of engagement with the chain by a top stop when the gripper assembly is at the upper end of its motion.

The gripping action is accomplished by the two part structure of the stake gripper assembly. The lower portion of the gripper assembly has two coacting clamp arms attached to it at pivot points, with the arms constructed so that as the arms approach each other they will pinch a stake between them. The upper portion of the gripper assembly moves independently of the lower portion and is the portion which connects to the moving chain. The only connections between the lower and upper portions of the gripper assembly are two pins attached to the upper portion which are captured within slots within the pivoting clamp arms of the lower portion. These slots within the arms are curved so that their lower ends, the ends near the two pivots, are closer together than their upper ends. Thus, when the upper portion of the assembly is lifted up, the pins move up within the slots in the clamp arms of the lower portion, and force the clamp arms together. This clamping action is increased by any resistance from the stake clamped between the arms, because the lower portion of the gripper assembly attempts to separate from the moving upper portion which drives the clamp arms together with greater force.

The invention thereby easily lifts the stake out from the ground with the force generated by the geared down motor. In the preferred embodiment, the motor used is 2½ horsepower gasoline motor operating at 9000 rpm and geared down by a ratio of 9000 to 66. A centrifugal clutch is used to control the stake pulling action so that merely reducing the throttle stops the motion of the chain. This type of engine and control is also typically used on chain saws, which makes it easier to appreciate the low weight and ease of operation of the invention.

DETAILED DESCRIPTION OF THE INVENTION

STRUCTURE OF THE PREFERRED EMBODIMENT

Figure 1:
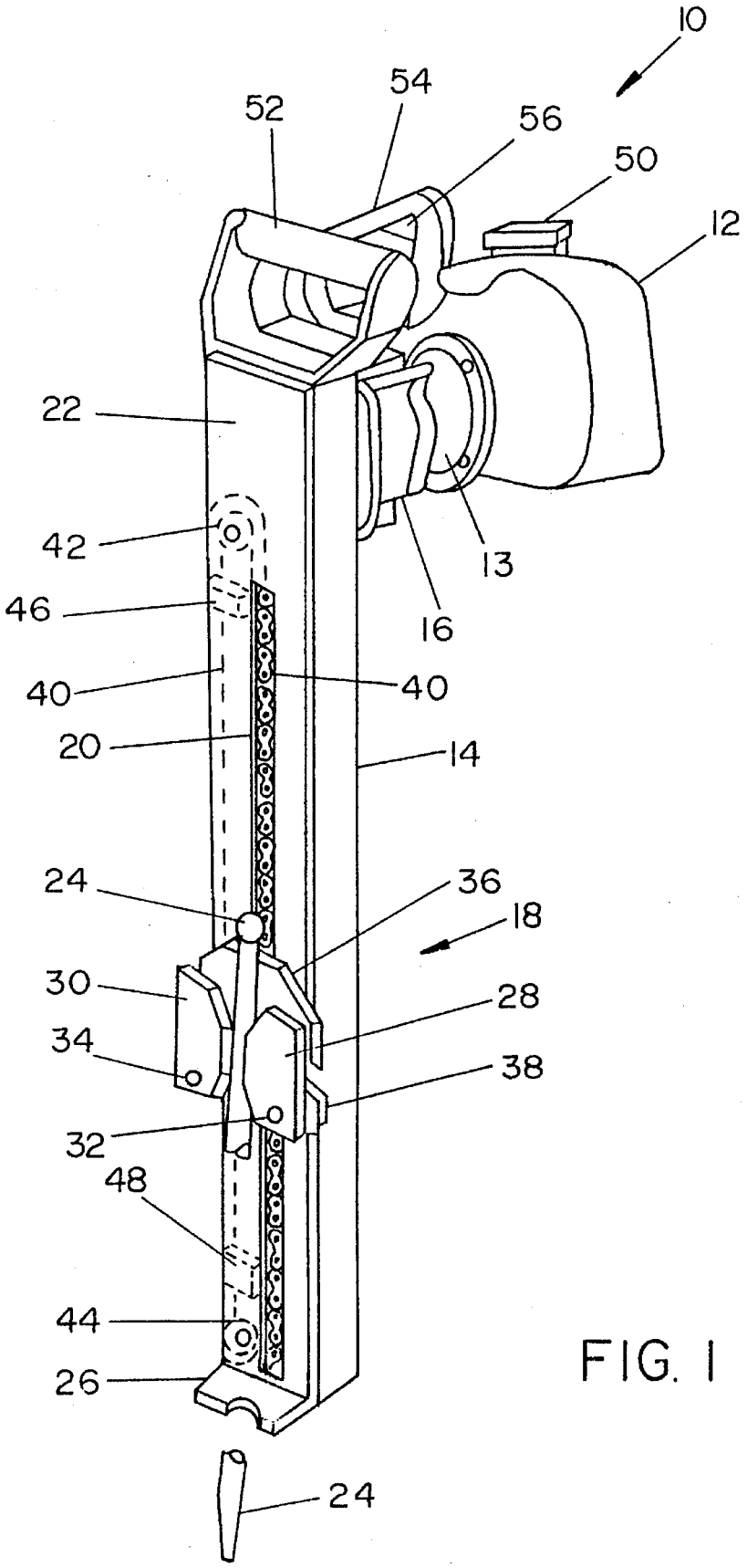
FIG. 1 is a pictorial view of the preferred embodiment of the invention.

FIG. 1 is a pictorial view of the preferred embodiment of stake puller 10 of the invention in which gasoline engine 12 is attached to box frame 14 through centrifugal clutch 13 and gear box 16. Gripper assembly 18 is captured within guide slot 20 of cover 22 of box frame 14, so that gripper assembly 18 slides up and down within slot 20.

Gripper assembly 18 engages stake 24 as gripper assembly 18 is lifted off of foot 26 at the bottom of box frame 14. Stake 24 is clamped between clamp arms 28 and 30, which pivot on their respective pivot points 32 and 34 and are forced against stake 24 by the separation of upper portion 36 of gripper assembly 18 from lower portion 38. This action is described in more detail in the discussion of FIG. 2.

Gripper assembly 18 is moved by endless chain 40 which moves up in the approximate center of box frame 14, where it is approximately aligned with slot 20. Chain 40 is stretched between drive sprocket 42 (indicated by dashed lines) and idler sprocket 44 (also shown by dashed lines) to form a clear unobstructed path between them. Near the top of box frame 14, chain 20 is driven and its direction is reversed by drive sprocket 42 which is connected to conventional gears within gear box 16. Chain 40 moves downward near the edge of box frame 14, as shown by dashed lines, and moves around idler sprocket 44 near the bottom of box frame 14 so that chain 40 begins its upward travel close to the bottom of box frame 14.

Two other important components of the invention are also shown by dashed lines on FIG. 1 in order to show their location within stake puller 10. Top stop 46 is located below drive sprocket 42 within box frame 14, at a location predetermined as the end of upward travel by gripper assembly 18, and bottom mechanical stop 48 is located near the bottom of frame 14, above idler sprocket 44. As described in regard to FIG. 3, bottom stop 48 is the engagement means which causes the action by which gripper assembly 18 engages endless chain 40, and top stop 46 is the disengagement means which initiates the action to disconnect gripper assembly 18 from chain 40, thus permitting gripper assembly 18 to fall to the bottom of slot 20 because of its own weight.

Figure 2:
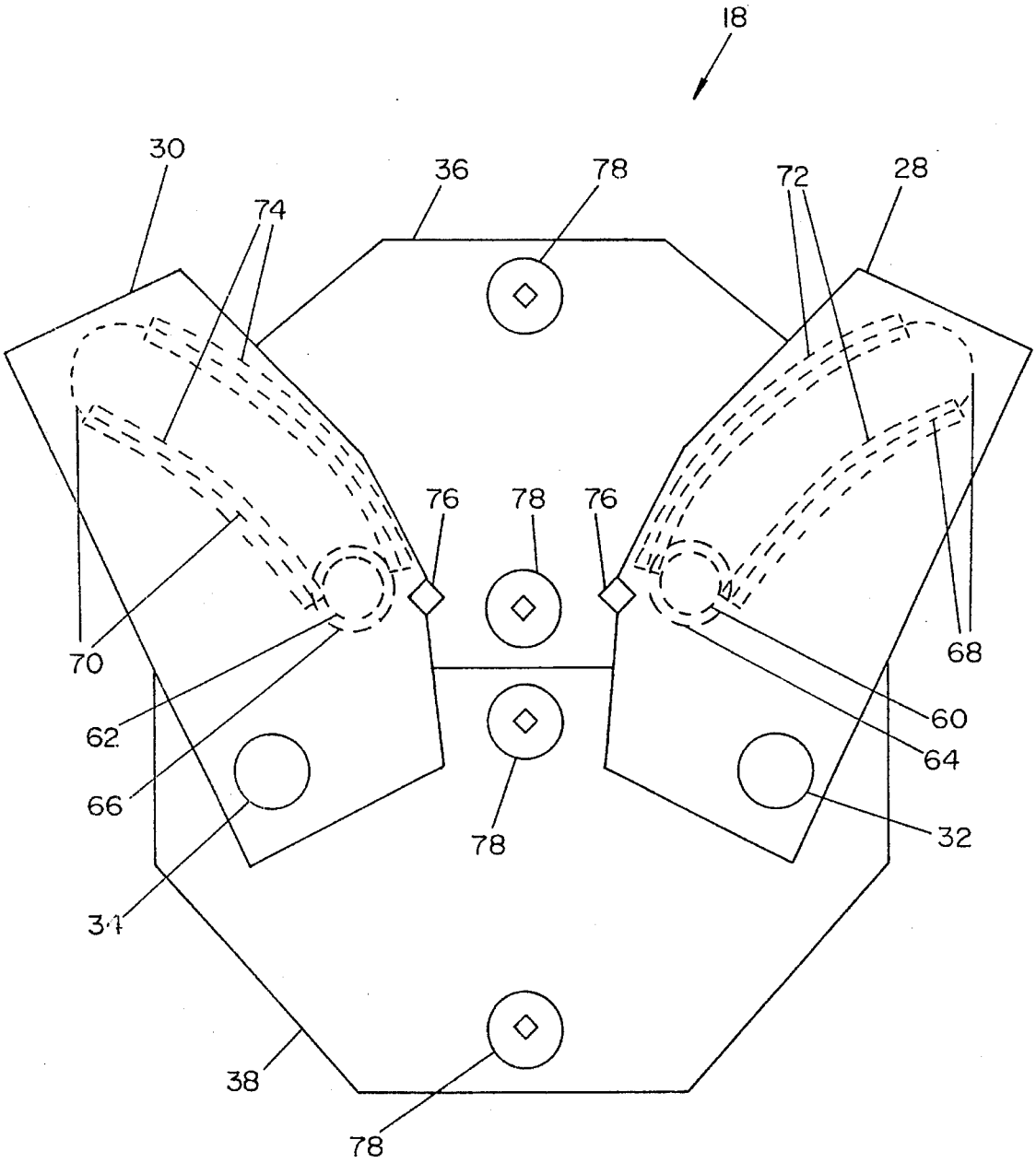
FIG. 2 is an enlarged front view of the gripper assembly of the invention.

FIG. 2 is an enlarged front view of gripper assembly 18 of the preferred embodiment of the invention, which can be used to best describe the action by which gripper assembly 18 clamps onto a stake. As previously explained, upper portion 36 is separate from lower portion 38. Their only interconnection is that pins 60 and 62 with heads 64 and 66, which are attached to upper portion 36, are captured within curved slots 68 and 70 within clamp arms 28 and 30. Pins 60 and 62 are located equidistant from the point where clamp arms 28 and 30 meet. Actually, heads 64 and 66 move within slots 68 and 70, and guides 72 and 74, which are attached to clamp arms 28 and 30 to cover the edges of the slots, reduce the width of the slots so that the bodies of pins 60 and 62 move in contact with guides 72 and 74. This arrangement prevents the pins from being pulled out of the slots.

The curves of slots 68 and 70 are oriented so that the bottom ends of the slots are closer to pivot points 32 and 34 than their top ends and the bottom ends of the two slots are closer together than their top ends. The slots are also convex when viewed from the point where clamp arms 28 and 30 meet.

Clamp arms 28 and 30 are then attached to lower portion 38 at pivot points 32 and 34, thus completing the interconnection between upper portion 36 and lower portion 38. When gripper assembly 18 is resting at the bottom of guide slot 20, it appears as shown in FIG. 2, so that upper portion 36 rests upon lower portion 38 and clamp arms 28 and 30 are separated by their maximum distance which prevents a tent stake 24 from being engaged by clamp arms 28 and 30.

However, as can be seen from FIG. 2, as upper portion 36 is lifted away from lower portion 38, pins 60 and 62 also move up, and in doing so act against curved slots 68 and 70 to push clamp arms 28 and 30 together. Jaw points 76, made of very hard material, may be attached to clamp arms 28 and 30 at the points where they contact the stake to provide an even greater "bite" into the stake. Several screws 78 penetrate upper portion 36 and lower portion 38, which, in the preferred embodiment, are constructed of one quarter inch thick steel, to attach other components which are shown in FIG. 3.

Figure 3:
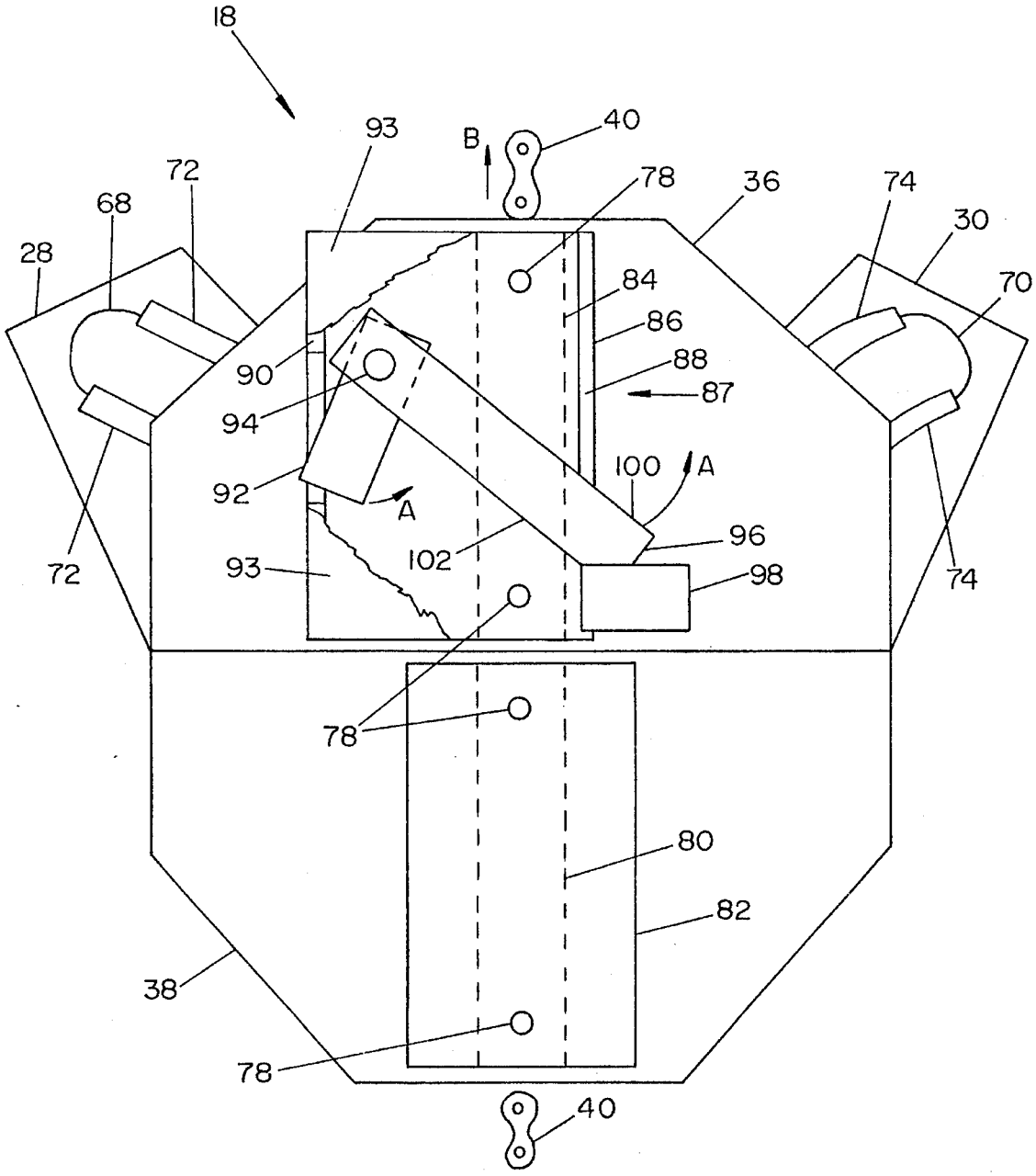
FIG. 3 is an enlarged rear view of the gripper assembly of the invention.

FIG. 3 is an enlarged rear view of gripper assembly 18 of the preferred embodiment of the invention in which is shown the structure for attaching gripper assembly 18 to slot 20 (FIG. 1) and the mechanism for engaging and disengaging gripper assembly 18 with chain 40 (FIG. 1). Only two links of chain 40 are pictured in FIG. 3 to show the alignment of gripper assembly in regard to chain 40. The balance of chain 40 is not shown in order to permit easier viewing of the other components. Chain 40 moves along the center of gripper assembly 18 and in front of the view seen in FIG. 3.

As seen in FIG. 3 the back side of lower portion 38 is of very simple construction. Only spacer 80 and plate 82 are attached to it, and both are held in place by screws 78 (also seen in FIG. 2) which thread into threaded holes in plate 82. Spacer 80 is of approximately the same dimensions as slot 20 (FIG. 1), so that the combination of spacer 80 and plate 82 hold lower portion 38 within slot 20.

In the same manner spacer 84 and plate 86 are attached to upper portion 36, and also hold it within slot 20. However, plate 86 has an additional box structure 87 built upon it, which consists of sides 88 and 90 and cover plate 93. Only a small part of cover plate 93 is shown in FIG. 3, with most of it cut away to expose the internal mechanism. The path of chain 40 passes through box 87, and it is the mechanism within box 87 which alternately engages and disengages gripper assembly 18 with chain 40.

Pivoting dog 92 which is attached to pivot rod 94 is the device which engages upper portion 36 and gripper assembly 18 with chain 40. Dog 92 is shown in FIG. 3 in the position in which it is disengaged from chain 40. To cause engagement, control lever 96, shown in FIG. 3 resting upon lever stop 98, is rotated in the direction indicated by arrow A. Lever 96 is also attached to pivot rod 94 which is attached to plate 86 in a manner to permit rotation of pivot rod 94. Thus, when lever 96 is rotated in direction A, dog 92 rotates in the same direction and is brought into engagement with chain 40. Once dog 92 is caught by chain 40, dog 92, gripper assembly 18, and stake 24 (FIG. 1) are all pulled along with chain 40 which is moving up in the direction indicated by arrow B.

This upward movement continues until gripper assembly 18 reaches the top of its predetermined travel, at which time top surface 100 of lever 96 is struck by top stop 46 (FIG. 1), turning lever 96 in the direction opposite from direction A, and dog 92 is disengaged from chain 40. Similarly, when gripper assembly 18 falls to the bottom of slot 20, bottom stop 48 (FIG. 1) strikes lever 96 on its bottom surface 102. This contact causes lever 96 to rotate in direction A, and dog 92 rotates into engagement with chain 40.

The simple structure shown in FIG. 3 thereby furnishes the automatic engagement and disengagement of gripper assembly 18 with chain 40, and depends only on the location of gripper assembly within slot 20. Gripper assembly 18 always engages with the chain at the bottom of stake puller 10 and disengages from the chain at the top of its travel. At any location in between the top and bottom, gripper assembly 18 will either be raised to the top if it is engaged with the chain or fall to the bottom if it is not.

OPERATION OF THE PREFERRED EMBODIMENT

The operation of stake puller 10 is quite simple. In regard to FIG. 1, gasoline engine 12 is started by conventional means, such as pulling starter cord handle 50. Once started, the operator holds stake puller 10 with one hand upon handle 52 which is attached above box frame 14, and the other hand on engine handle 54. Engine handle 54 includes engine throttle control 56 integrated into handle 54 in conventional fashion. Engine 12 is attached to conventional centrifugal clutch 13, which is a common device in engines used for chain saws, so that no rotating shaft output is delivered to gear box 16 unless engine 12 is operating at a predetermined minimum speed.

When engine 12 is brought to the appropriate speed, drive sprocket 42 begins to rotate and chain 40 begins to travel around its loop. Under normal operating conditions, the operator locates stake 24 between clamp arms 28 and 30 of gripper assembly 18 before operating throttle control 56 to speed up engine 12. Because gripper assembly 18 is resting on bottom stop 48, gripper assembly is engaged with chain 40, and as engine 12 is speeded up, chain 40 begins to move, pulling gripper assembly 18 up with it. As explained in regard to FIG. 2, the motion imparted to gripper assembly 18 causes stake 24 to be tightly gripped between clamp arms 28 and 30.

In the preferred embodiment engine 12 is geared down by the ratio of 9000 to 66. This provides a high torque and is sufficient to pull any stake from the ground, even though engine 12 is only rated at 2½ horsepower.

As stake 24 is raised, and regardless of whether or not it is actually pulled clear of the ground, when gripper assembly 18 contacts top stop 46, gripper assembly 18 is disengaged from chain 40. At that point, the weight of upper portion 36 causes it to fall onto lower portion 38, thus separating clamp arms 28 and 30. As clamp arms 28 and 30 separate they release from stake 24, and entire gripper assembly 18 falls to the bottom of slot 20, where it hits bottom stop 48 which causes gripper assembly 18 to attach to chain 40 and repeat the upward movement. If the minimum engine speed to activate centrifugal clutch 13 is maintained, the cycle will immediately begin again. This is particularly desirable if the stake has not been completely pulled from the ground, however, all that is required to stop the operation and move on to the next stake to be pulled is to reduce the engine speed.

The invention therefore provides a lightweight, portable stake puller which is easily operated by one person, and which quickly and effectively pulls any conventional stake from the ground regardless of the length and the force required.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, different engines, gear ratios and clutch arrangements may be used. Furthermore, different structures may be used for mechanical stops 46 and 48, or a different apparatus, such as a mechanical clutch, could be used to engage and disengage gripper assembly 18 from chain 40.

What is claimed as new and for which Letters Patent of the United States are desired to be secured is:

1. A stake pulling apparatus comprising:

a gasoline engine;

a speed reducing apparatus interconnected with and driven by the engine;

a chain drive sprocket interconnected with and driven by the speed reducing apparatus;

a frame supporting the chain drive sprocket;

a chain idler sprocket supported by the frame, located at one end of the frame, and separated from the drive sprocket;

an endless loop of chain stretched between the drive sprocket and the idler socket forming at least one unobstructed straight path of travel from the idler sprocket to the drive sprocket;

a guide slot attached to the frame, with the slot aligned parallel to the chain's straight path from the idler sprocket to the drive sprocket, and the guide slot having an upper end adjacent to the drive sprocket and a lower end adjacent to the idler sprocket;

a gripper assembly comprising:

a lower portion, with an attachment means to attach the lower portion to the guide slot, so that the lower portion can slide within the guide slot;

two clamp arms, each attached to the lower portion by a pivoting means, with each clamp arm including a curved slot, with each slot having a lower end and an upper end, with the lower end closer to the pivoting means than the upper end, and with the lower ends of the curved slots closer together than the upper ends;

an upper portion, with an attachment means to attach the upper portion to the guide slot so that the upper portion can slide within the guide slot;

two pins attached to the upper portion with one pin captured within each of the curved slots of the clamp arms;

a chain engagement and disengagement means attached to the upper portion of the gripper assembly;

a disengagement control means attached to the frame and located at a predetermined height to which the gripper assembly is to travel, so that upper portion of the gripper assembly is disengaged from the chain when the gripper assembly approaches the predetermined height; and an engagement control means attached to the frame and located adjacent the lower end of the frame, so that upper portion of the gripper assembly is engaged with the chain when the gripper assembly is at the bottom of its travel path.

2. The stake pulling apparatus of claim 1 wherein the speed reducing apparatus is a gear box.

3. The stake pulling apparatus of claim 1 further including a centrifugal clutch interconnecting the gasoline engine to the speed reducing apparatus.

4. The stake pulling apparatus of claim 1 wherein the guide slot is located within a cover attached to the frame.

5. The stake pulling apparatus of claim 1 further including jaw points attached to the clamping arms at the locations where the clamping arms contact a stake to be pulled.

6. The stake pulling apparatus of claim 1 wherein the chain engagement and disengagement means is a pivoting dog to which is connected a pivoting control lever.

7. The stake pulling apparatus of claim 1 wherein the disengagement control means is a mechanical upper stop.

8. The stake pulling apparatus of claim 1 wherein the engagement control means is a mechanical lower stop.

9. The stake pulling apparatus of claim 1 wherein the chain engagement and disengagement means is a pivoting dog to which is connected a pivoting control lever, the disengagement control means is a mechanical upper stop which contacts the control lever at the top of the travel of the gripper assembly, and the engagement control means is a mechanical lower stop which contacts the control lever at the bottom of the travel of the gripper assembly.

* * * * *